United States Patent [19]

Hayashi et al.

[11] 4,355,614

[45] Oct. 26, 1982

[54] ELECTRONIC FUEL INJECTION CONTROL APPARATUS OF AN INTERNAL COMBUSTION ENGINE

[75] Inventors: Kunihisa Hayashi; Masakazu Moriyama, both of Toyota, Japan

[73] Assignee: Toyota Jidosha Kogyo Kabushiki Kaisha, Toyota, Japan

[21] Appl. No.: 263,468

[22] Filed: May 14, 1981

[30] Foreign Application Priority Data

May 16, 1980 [JP] Japan ..... 55-064030

[51] Int. Cl.[3] ..... F02B 3/00

[52] U.S. Cl. ..... 123/436; 123/487; 123/488

[58] Field of Search ..... 123/436, 478, 486, 487, 123/492, 493, 488

[56] References Cited

U.S. PATENT DOCUMENTS 4,245,590 1/1981 Grozinger et al. ..... 123/487 X 4,323,042 4/1982 Woodhouse et al. ..... 123/436

*Primary Examiner*—Tony M. Argenbright

*Attorney, Agent, or Firm*—Kenyon & Kenyon

[57] ABSTRACT

Small change in the period of a crank-angle signal which is generated at every crankshaft rotation of a predetermined angle is not faithfully reflected to a false crank-angle signal which is used by a fuel injection control device for detecting the engine's running speed. Thus, even when the actual running speed is varied, the running speed recognized by the fuel injection control device doesn't change faithfully to this variation. Therefore, the amount of fuel injected into the engine, which amount is calculated in accordance with the running speed, doesn't vibrate with the variation of the running speed, preventing the surge phenomenon from occurring.

6 Claims, 7 Drawing Figures

ELECTRONIC FUEL INJECTION CONTROL APPARATUS OF AN INTERNAL COMBUSTION ENGINE

BACKGROUND OF THE INVENTION

The present invention relates to an electronic fuel injection control apparatus for an internal combustion engine.

There is a known electronic fuel injection control device (hereinafter referred to as an EFI control device) which calculates the amount of fuel to be supplied to the engine based upon an electrical signal indicating the operating condition of the engine, i.e. a running speed signal, which adjusts the fuel supply amount in accordance with the calculated value. In a vehicle on which an internal combustion engine has such an EFI control device mounted, a surge phenomenon or a low-frequency vibration in the back and forth directions of the vehicle owing to the EFI control, often occurs. In the running speed is changed due to the irregular combustion in the engine, the EFI device detects this change in the running speed and varies the amount of fuel supplied to the engine in response to the detected change of the running speed. Accordingly, the change in the running speed is further escalates and thus the resonance between the EFI control device and the drive system of the vehicle occurs causing the surge phenomenon of the vehicle. A surge of this kind turns out to be very uncomfortable for the driver, and it has been desired to prevent the surge from occurring as far as possible or to minimize the amplitude of the surge.

SUMMARY OF THE INVENTION

It is, therefore, an object of the present invention to provide an electronic fuel injection control apparatus which can greatly reduce or preferably prevent the occurrence of surge in the vehicle.

According to the present invention, an electronic fuel injection control apparatus comprises: means for generating a first electrical signal at every crankshaft rotation of a predetermined angle; means for generating a second electrical signal having a level which corresponds to a varying quantity in the period of the first electrical signal; means for generating a third electrical signal having a period, a varying quantity of the third electrical signal period being maintained at a constant value or constant values irrespective of the varying quantity of the first electrical signal period when the second electrical signal is smaller than or equal to a predetermined value, a varying quantity of the third electrical signal period being changed in response to the varying quantity of the first electrical signal period when the second electrical signal is greater than the predetermined value; and means for adjusting the amount of fuel injected into the engine, in response to the period of the third electrical signal.

The above and other related objects and features of the present invention will be apparent from the description of the present invention set forth below, with reference to the accompanying drawings, as well as from the appended claims.

DETAILED EXPLANATION OF THE PREFERRED EMBODIMENT

Figure 1:
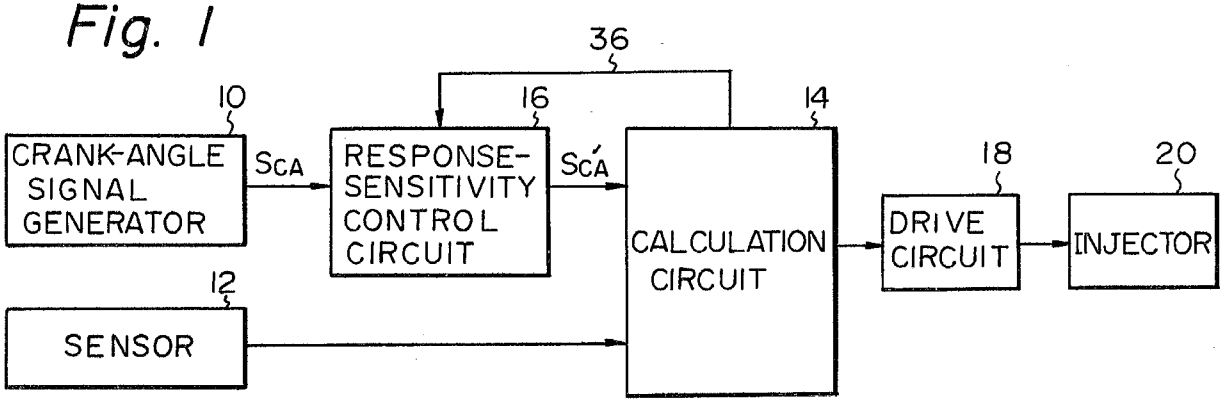
FIG. 1 is a block diagram schematically illustrating an embodiment of the present invention.

FIG. 1 is a diagram schematically illustrating an embodiment according to the present invention, in which reference numeral 10 denotes a crank-angle signal generator which generates an electrical crank-angle signal every rotation of the crankshaft of an internal combustion engine at a predetermined angle, and 12 denotes a sensor which generates electrical signals, except for a running speed signal, that represent the operating condition of the engine, i.e., which generates an intake air-amount signal, an intake negative-pressure signal and the like. The crank-angle signal generator 10 may be the one which magnetically or optically detects the rotation of the crankshaft of the engine or the rotation of the distributor shaft, or may be the one which takes out ignition signals such as of an igniter or which takes out signals from the primary winding of the ignition coil.

A calculation circuit 14 is a widely known one which produces an electrical signal that indicates a running speed of the engine based upon the period of crank-angle signals fed from the crank-angle signal generator 10 via a response-sensitivity control circuit 16, and which calculates an optimum amount of fuel injection at that moment, relying upon the calculated running speed signal and upon another operating condition signals such as an intake air amount signal fed from the sensor 12. The fuel injection amount signal calculated by the calculation circuit 14 is fed to a fuel injection valve injector 20 via a drive circuit 18, and the fuel is injected into the engine responsive to the calculated fuel amount.

The above-mentioned setup, except the response-sensitivity control circuit 16, has been similarly constructed for the fuel injection control device that is practically employed for many engines, and is not specifically illustrated here.

Figure 2:
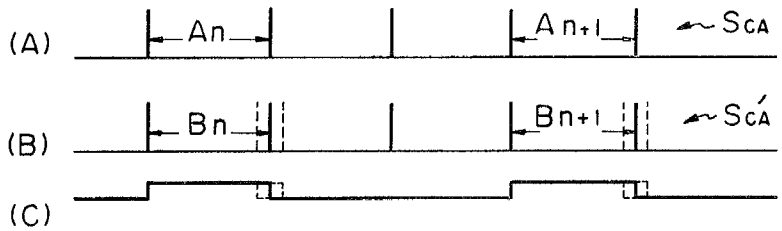
FIG. 2 is a time chart illustrating the basic operation of the present invention.

The response-sensitivity control circuit 16 works to blunt the response characteristics under particular condition so that variation in the period of a detected crank-angle signal $S_{CA}$ is not faithfully reflected to the period of a crank-angle signal $S'_{CA}$ that is fed to the calculation circuit 14. FIG. 2-(A) illustrates crank-angle signals $S_{CA}$ from the crank-angle signal generator 10, and FIG. 2-(B) illustrates false crank-angle signals $S'_{CA}$ that are fed from the response-sensitivity control circuit 16 to the calculation circuit 14. As is obvious from these two diagrams, the period of the signals $S'_{CA}$ does not vary faithfully to the period of the signals $S_{CA}$. Therefore, even when the running speed of the engine is varied, the running speed recognized by the calculation circuit 14 does not change faithfully to the above-mentioned variation. Accordingly, the amount of fuel injected does not much change, and the phenomenon of surge is restrained.

The calculation circuit 14 usually calculates the amount of fuel injection once at each crankshaft rotation, and, in the case of a four-cycle six-cylinder engine, three crank-angle signals are generated at each crankshaft rotation. Therefore, a period used for calculating the running speed signal (hereinafter referred to as speed-calculation period) appears once per three periods of the crank-angle signal. Accordingly, response characteristics of the response-sensitivity control circuit 16 are controlled during the speed-calculation period only, as illustrated in FIG. 2-(B). FIG. 2-(C) illustrates synchronizing signals that are sent back to the response-sensitivity control circuit 16 from the calculation circuit 14, and assume the high level only during the speed calculation period of the signals $S'_{CA}$.

Below is briefly illustrated with reference to algorithm of the response-sensitivity control circuit 16. If a given speed calculation period of a signal $S_{CA}$ is denoted by $A_n$, a subsequent speed calculation period by $A_{n+1}$, and if periods of signals $S'_{CA}$ corresponding to the periods $A_n$, $A_{n+1}$ of the signals $S_{CA}$ are denoted by $B_n$ and $B_{n+1}$, as shown in FIGS. 2-(A) and 2-(B), the response-sensitivity control circuit 16 performs, first, the calculation of $B_n-A_{n+1}$ to find the increasing or decreasing degree of the running speed of the engine, i.e., to find the acceleration or deceleration degree of the engine. When $B_n-A_{n+1}\geqq 0$, the engine is in the state of acceleration or constant-speed operation; i.e., the running speed increases or remains constant. Under this condition, when $B_n-A_{n+1}$ is smaller than a predetermined value $T_o$, i.e., when the increasing degree of the running speed is small, there holds the following relation, $$B_{n+1}=B_n-\alpha(T_o\geqq B_n-A_{n+1}\geqq 0)$$

whereby the degree of change in the period of the signals $S'_{CA}$ is set to a predetermined value $\alpha$ irrespective of the degree of change in the period of the signals $S_{CA}$. Further, when $B_n-A_{n+1}$ is greater than $T_o$, i.e., when the increasing degree of the running speed is great, the degree of change in the period of signals $S'_{CA}$ is so controlled as to vary following the degree of change in the period of signals $S_{CA}$, as given as follows:

$$B_{n+1}=A_{n+1}-T_o(B_n-A_{n+1}>T_o)$$

When $B_n-A_{n+1}<0$, the running speed of the engine decreases. Even in this case, the degree of change in the period of signals $S'_{CA}$ is set to a predetermined value $\beta$ irrespective of the degree of change in the period of signals $S_{CA}$, when the degree of speed decrease is small. Namely, there holds a relation $B_{n+1}=B_n+\beta(-T_o\leqq B_n-A_{n+1}<0)$.

When the decreasing degree of the running speed is great, the degree of change in the period of signals $S'_{CA}$ is so controlled as to vary following the degree of the change in the period of signals $S_{CA}$, as given by, $$B_{n+1}=A_{n+1}+T_o(B_n-A_{n+1}<-T_o)$$

Therefore, when the degree of change in the running speed of the engine is relatively small, i.e., when it is regarded that the surge has developed in the engine, the degree of change in the running speed recognized by the calculation circuit 14 does not respond to the degree of practical change; the response sensitivity is blunted. Consequently, the surge of the vehicle is restrained.

Figure 3:
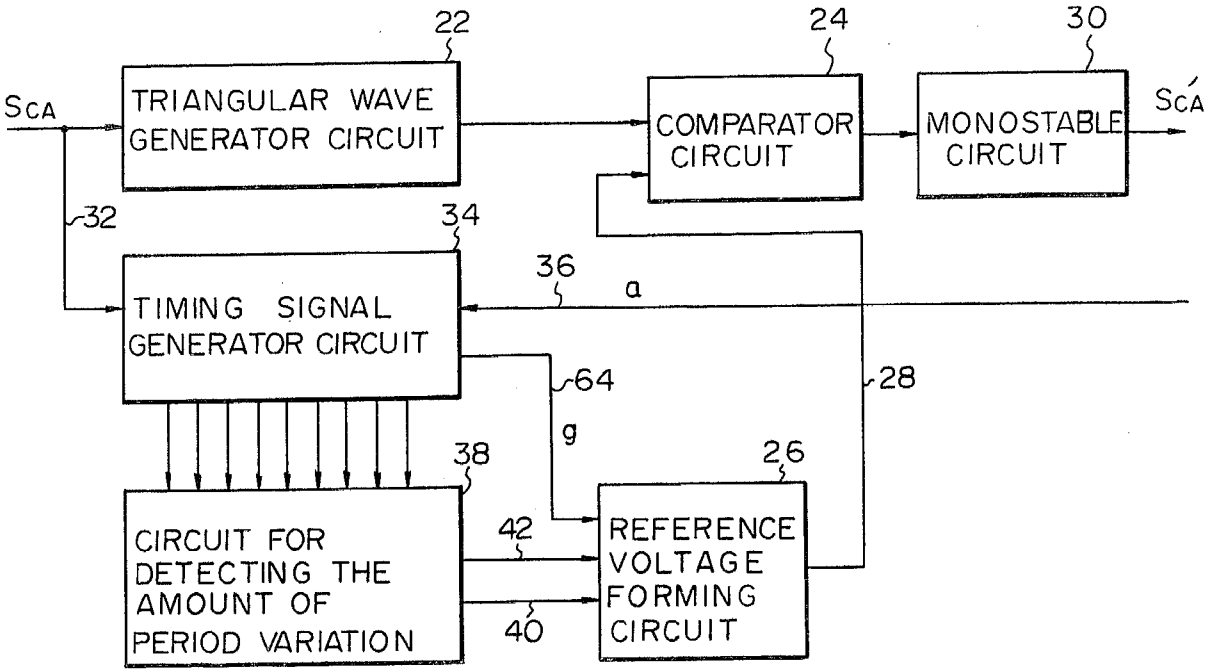
FIG. 3 is a block diagram illustrating in detail, a part of FIG. 1.

Below is illustrated the detailed construction of the response-sensitivity control circuit 16 according to the present invention. FIG. 3 is a block diagram illustrating the construction of the response-sensitivity control circuit 16, in which reference numeral 22 denotes a triangular wave generator circuit which generates a triangular wave signal having a predetermined time width and a predetermined inclination after every receipt of the crank-angle signal $S_{CA}$ from the crank-angle signal generator 10 (refer to FIG. 1), and 24 denotes a comparator circuit which compares a triangular wave signal from the triangular wave generator circuit 22 with a variable reference voltage which is supplied from a reference voltage forming circuit 26 via a line 28, and which produces an output of the high level when the level of the triangular wave signal is greater than the level of the reference voltage. Furthermore, in FIG. 3, 30 denotes a monostable circuit which is triggered at a moment at which the output of the comparator circuit 24 rises and which produces a false crank-angle signal $S_{CA}$ having a pulse width nearly equal to that of the crank-angle signal $S_{CA}$. The crank-angle signal $S_{CA}$ from the crank-angle signal generator 10 (refer to FIG. 1) is further applied to a timing signal generator circuit 34 via a line 32. Based upon the crank-angle signal $S_{CA}$ and the synchronizing signals fed from the calculation circuit 14 (see FIG. 1) via a line 36, the timing signal generator circuit 34 forms a variety of operation timing signals for a circuit 38 for detecting the variation of period as well as control signals for controlling the analog switches in the reference voltage forming circuit 26.

The circuit 38 for detecting the variation of period finds a time difference between the present speed calculation period $A_{n+1}$ of the crank-angle signal $S_{CA}$ and the previous speed calculation period $B_n$ of the crank-angle signal $S'_{CA}$, which takes place just before the period $A_{n+1}$, and feeds an analog voltage having positive polarity or negative polarity that corresponds to the difference as well as a polar signal that represents positive polarity or negative polarity to the reference voltage forming circuit 26 via lines 40 and 42.

During the ordinary period, in other words the period except the speed calculation period, of the crank-angle signal $S_{CA}$, the reference voltage forming circuit 26 produces, as reference voltage, a standard voltage of a level one-half the crest value of the triangular wave signal sent from the triangular wave generator circuit 22. During the speed calculation period, the reference voltage forming circuit 26 adds the above-mentioned analog voltage from the circuit 38 for detecting the variation of period and a predetermined voltage to the standard voltage, and the voltage obtained by the addition is limited to a maximum value or a minimum value by a voltage limiter circuit, and is produced as a reference voltage via a line 28.

Construction and operation of the timing signal generator circuit 34, the circuit 38 for detecting the variation in period and the reference voltage forming circuit 26, will now be explained below with reference to block diagrams of FIGS. 4 to 6 and a time chart of FIG. 7.

Figure 4:
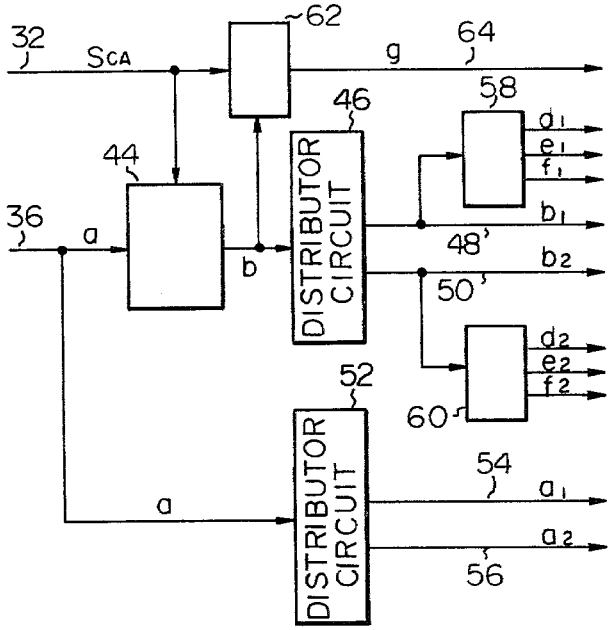
FIGS. 4, 5 and 6 are block diagrams illustrating in detail, parts of FIG. 3.

FIG. 4 illustrates the construction of the timing signal generator circuit 34, in which reference numeral 44 denotes a circuit for forming a gate control signal. Based upon the crank-angle signal $S_{CA}$ which is applied through the line 32 as shown in FIG. 7-(A) and a synchronizing signal a which is applied from the operation circuit 14 (see FIG. 1) via a line 36 as shown in FIG. 7-(D), the gate control signal forming circuit 44 forms a gate control signal b which assumes the high level only during the speed calculation period of the crank-angle signals $S_{CA}$. The gate control signal b specifies a countdown period of an up/down counter in the circuit 38 for detecting the variation in period that will be mentioned later, and is distributed through a distributor circuit 46 into signals $b_1$ and $b_2$ that occur alternatively as shown in FIGS. 7-(G) and 7-(H), and are sent to the circuit 38 via lines 48 and 50.

The above-mentioned synchronizing signal a applied through the line 36 is also used as a gate control signal. However, the signal a specifies a count-up period of the up/down counter in the circuit 38. The gate control signal a is distributed through a distributor circuit 52 into signals $a_1$ and $a_2$ that occur alternatively as shown in FIGS. 7-(E) and 7-(F), and are fed to the circuit 38 via lines 54 and 56.

Operation control signal forming circuits 58 and 60 produce enable signals $d_1$, $d_2$, latch signals $e_1$, $e_2$, and reset signals $f_1$, $f_2$ successively after relatively short periods of times have passed from the moments at which the gate control signals $b_1$, $b_2$ fall; these signals are fed to the circuit 38.

Based upon the crank-angle signal $S_{CA}$ and the gate control signal b, a switch control signal forming circuit 62 produces a switch control signal g which assume the high level during the interval of crank-angle signals which interval develops subsequent to the gate control signal b. The switch control signal g is fed to the reference voltage forming circuit 26 via a line 64.

Figure 5:
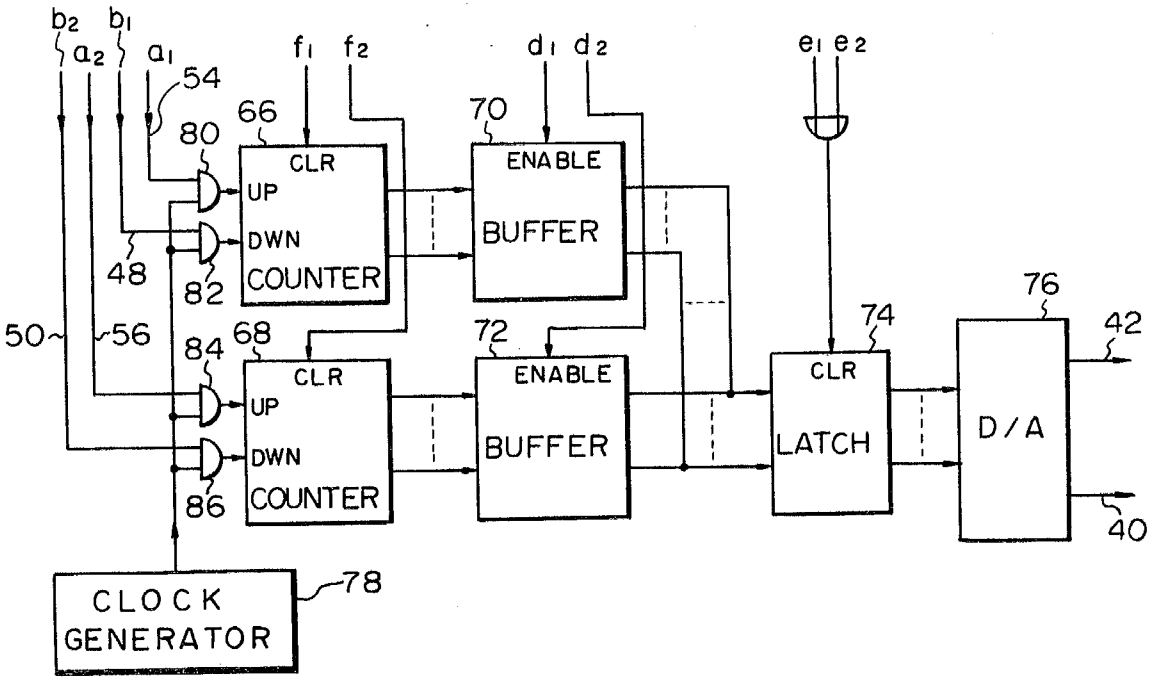

FIG. 5 illustrates the construction of the circuit 38 for detecting the variation of period, which consists of two up/down counters 66 and 68, buffers 70 and 72 having a function of data selector to select the output of these up/down counters, a latch circuit 74, a digital-to-analog converter 76 for converting the output of the latch circuit 74 into an analog signal, and a clock pulse generator 78 for feeding clock pulses to the up/down counters.

Figure 7:
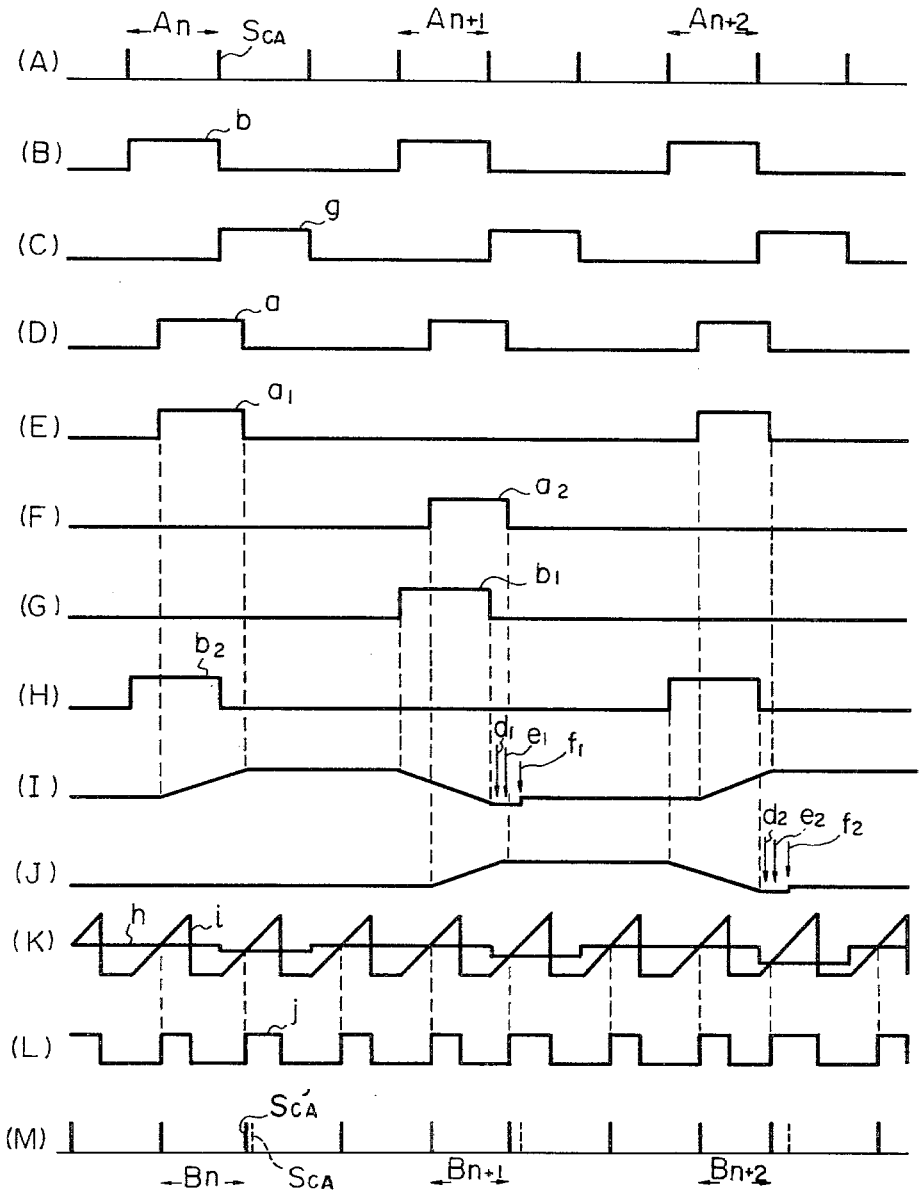
FIG. 7 is a time chart illustrating the detailed operation of the above embodiment.

When the gate control signal $a_1$ shown in FIG. 7-(E) assumes the high level, a gate 80 opens to permit the passage of a clock signal, whereby the up/down counter 66 performs the count-up operation. When the gate control signal $b_1$ shown in FIG. 7-(G) assumes the high level, a gate 83 opens to permit the passage of a clock signal, whereby the up/down counter 66 performs the count-down operation. In this case, the pulse width of the gate control signal $a_1$ is equal to the speed calculation period $B_n$ of the false crank-angle signal $S'_{CA}$ (refer to FIG. 7-(M)) that is applied to the calculation circuit 14 (FIG. 1) as mentioned earlier, and the pulse width of the gate control signal $b_1$ is equal to the speed calculation period $A_{n+1}$ of the crank-angle signal $S_{CA}$ (refer to FIG. 7-(A)). Therefore, the content of the up/down counter 66 at the moment when the count-down operation is finished becomes equal to the difference in the speed calculation periods, i.e., equal to a value that corresponds to the changing degree $B_n-A_{n+1}$ in the running speed of the engine. FIG. 7-(I) illustrates the content of the up/down counter 66.

The up/down counter 68 also performs the count-up operation and the count-down operation in the same manner as mentioned above, when gates 84 and 86 are opened by gate control signals $a_2$, $b_2$ that are shown in FIGS. 7-(F) and 7-(H). Therefore, the content of the up/down counter 68 when the count-down operation is finished becomes equal to a value that corresponds to the changing degree $B_{n+1}-A_{n+2}$ in the running speed of the engine. FIG. 7-(J) illustrates the content of the up/down counter 68.

The enable signal $d_1$ or $d_2$ is applied from the timing signal generator circuit 34 to the buffer 70 or 72 being slightly lagged behind the moment at which the count-down operation is finished, i.e., being slightly lagged behind the moment at which the gate control signal $b_1$ or $b_2$ falls. Hence, the content of the counter 66 or 68 is taken into the buffer 70 or 72, and then a latch signal $e_1$ or $e_2$ is fed to the latch circuit 74. Accordingly, the content of the buffer 70 or 72 is selectively stored in the latch circuit 74. Then, the content of the counter 66 or 68 is cleared away by a reset signal $f_1$ or $f_2$, so that it is ready for the next counting operation. The content of the latch circuit 74 is converted by the digital-to-analog converter 76 into an analog voltage which corresponds to the content, i.e., converted into an analog voltage having a value corresponding to $B_n-A_{n+1}$ or $B_{n+1}-A_{n+2}$ and having positive or negative polarity, and into a polar signal which indicates only the positive polarity or negative polarity of the content; the thus converted voltage and signal are fed to the reference voltage forming circuit 26 via lines 40 and 42.

Figure 6:
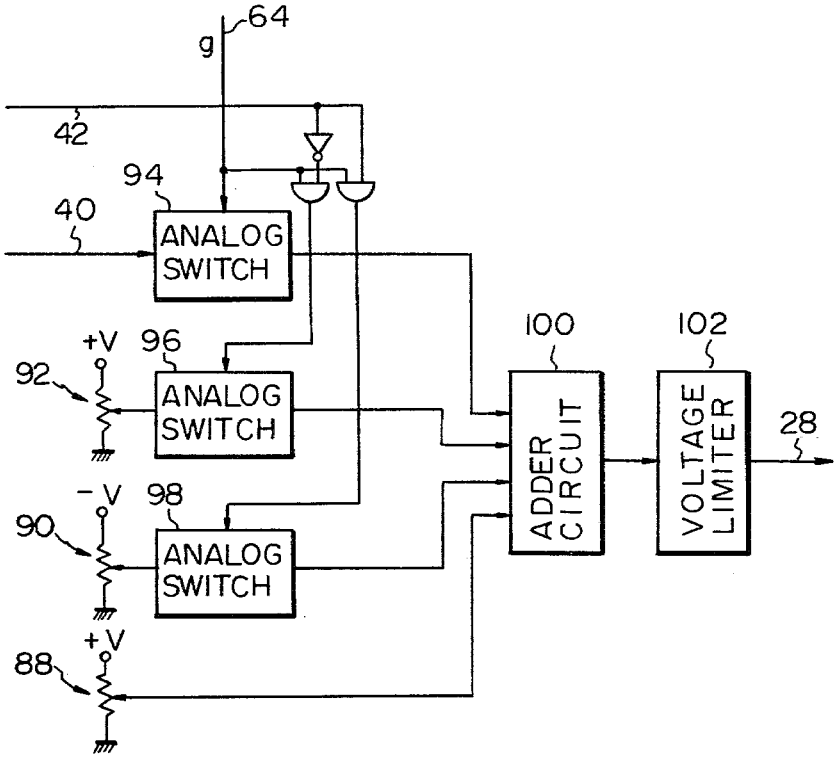

FIG. 6 illustrates the construction of the reference voltage forming circuit 26 which consists of three constant-voltage generator circuits 88, 90 and 92, three analog switches 94, 96 and 98, an adder circuit 100, and a voltage limiter circuit 102.

The constant-voltage generator circuit 88 produces a standard voltage of a level one-half the crest value of the triangular wave signals produced by the triangular wave generator circuit 22 of FIG. 3. The constant-voltage generator circuit 90 generates a predetermined constant voltage of negative polarity, and the constant-voltage generator circuit 92 generates a predetermined constant voltage of positive polarity.

The analog switches 94, 96 and 98 remain interrupted when a switch control signal g (refer to FIG. 7-(C)) fed from the timing signal generator circuit 34 via the line 64 is of the low level, i.e., remain interrupted during the ordinary period (the period except the speed calculation period) of the crank-angle signal $S_{CA}$. In this case, therefore, the adder circuit 100 is served only with the standard voltage from the constant-voltage generator circuit 88; the standard voltage is fed as a reference voltage h (refer to FIG. 7-(K)) to a voltage limiter circuit 102 and to the comparator circuit 24 via the line 28. When the switch control signal g is of the high level, i.e., during the speed calculation period of the crank-angle signal $S_{CA}$, the analog switch 94 is rendered conductive, and either one of the analog switch 96 or 98 is rendered conductive. Namely, the analog switch 98 is rendered conductive when the polar signal fed from the circuit 38 via a line 42 is high level which indicates the positive polarity, and the analog switch 96 is rendered conductive when the polar signal is low level which indicates the negative polarity.

Therefore, when $B_n-A_{n+1}\geqq 0$, i.e., when the engine is accelerating or under the constant-speed operation, the analog switches 94 and 98 are rendered conductive during the speed calculation period, and the adder circuit 100 is served with a voltage which corresponds to a value $B_n-A_{n+1}$ that is fed through the line 40, with the negative constant voltage from the constant-voltage generator circuit 90, and with the standard voltage from the constant-voltage generator circuit 88. A voltage consisting of the sum of these voltages is fed as a reference voltage to the comparator circuit 24.

On the other hand, when $B_n-A_{n+1}<0$, i.e., when the engine is decelerating, the analog switches 94 and 96 are rendered conductive during the speed calculation period, and the adder circuit 100 is served with a voltage corresponding to $B_n - A_{n+1}$, with the constant positive voltage from the constant-voltage generator circuit 92, and with the standard voltage from the constant-voltage generator circuit 88. A voltage consisting of the sum of these voltages is fed as a reference voltage to the comparator circuit 24.

However, when the output voltage of the adder circuit 100 falls beyond the upper-limit value or the lower-limit value of the voltage limiter circuit 102, the reference voltage is adjusted to come into agreement with the upper limit or the lower limit.

The thus obtained reference voltage h is compared with the triangular wave signal i from the triangular wave generator circuit 22 as shown in FIG. 7-(K), and a comparison output j is obtained as shown in FIG. 7-(L). Since the monostable circuit 30 is triggered by the rising edge, a false crank-angle signal $S'_{CA}$ is obtained as an output of the monostable circuit 30 as shown in FIG. 7-(M).

Below is illustrated how the aforementioned algorithm is accomplished by the above-mentioned embodiment.

If it is assumed that a value of the sum of the standard voltage and the voltage corresponding to $B_n - A_{n+1}$ is used as a reference voltage h, speed calculation periods $B_{n+1}$—$B_{n+m}$ of the false crank-angle signals $S'_{CA}$ remain constant at all times even when the period of the crank-angle signal $S_{CA}$ is changed. Namely, the voltage corresponding to $B_n - A_{n+1}$ represents a compensation quantity for cancelling the variation in the period of crank-angle signals $S_{CA}$. Therefore, when the running speed is rising, the speed calculation period $B_{n+1}$ of false crank-angle signal $S'_{CA}$ that is finally obtained by adding together the standard voltage, the voltage corresponding to $B_n - A_{n+1}$ and the constant positive or negative voltage, becomes a value $B_{n+1} = B_n - \alpha$ which is smaller than the previous speed calculation period $B_n$ by a constant value $\alpha$ which corresponds to the constant negative voltage produced by the constant-voltage generator circuit 90. When the running speed is decreasing, the period $B_{n+1}$ becomes a value $B_{n+1} = B_n + \beta$ which is greater than the previous speed calculation period $B_n$ by a predetermined value $\beta$ that corresponds to the constant positive voltage produced by the constant-voltage generator circuit 92.

When the running speed rapidly increases or decreases, i.e., when the engine is accelerating or decelerating, the voltage corresponding to $B_n - A_{n+1}$ increases toward the positive direction or the negative direction. Therefore, the output voltage of the adder circuit 100 increases toward the positive direction or the negative direction, correspondingly. In this case, therefore, the voltage limiter circuit 102 so operates that the reference voltage h becomes equal to the upper-limit voltage or the lower-limit voltage. Consequently, the speed calculation period $B_{n+1}$ of a false crank-angle signal $S'_{CA}$ becomes greater or smaller than the speed calculation period $A_{n+1}$ of a crank-angle signal $S_{CA}$ by a predetermined value $T_o$ which corresponds to either the above-mentioned upper-limit voltage or the lower-limit voltage. In effect, the period $B_{n+1}$ becomes $B_{n+1} = A_{n+1} - T_o$ or $B_{n+1} = A_{n+1} + T_o$.

According to the present invention as mentioned above, a small degree change in the running speed, which change may produce the phenomenon of surge, is restrained so that the speed calculation period $B_{n+1}$ of a false crank-angle signal $S'_{CA}$ does not respond to the speed calculation period $A_{n+1}$ of a crank-angle signal $S_{CA}$. However, when a large degree change in the running speed, which change is regarded as the acceleration operation or the deceleration operation of the engine, occurs, the speed calculation period $B_{n+1}$ of a false crank-angle signal $S'_{CA}$ is so controlled as to follow the speed calculation period $A_{n+1}$ of a crank-angle signal $S_{CA}$ having a time delay of the predetermined value $T_o$. During ordinary periods except the periods of speed response, the false crank-angle signal $S'_{CA}$ follows the crank-angle signal $S_{CA}$ being lagged behind it by a predetermined value since the standard voltage serves as a reference voltage.

According to the above-mentioned embodiment, the level of steady-state surge can be reduced to one-fourth or less, that develops when the engine runs over a range of 1000 rpm to 3000 rpm with the shift lever of the manual transmission system being set at the third speed or the fourth speed position. Furthermore, it is possible to greatly reduce the level of vibration that develops in the back-and-forth direction immediately after the acceleration or the deceleration of the engine, as well as to greatly reduce the duration of vibration.

According to the present invention as illustrated in detail in the foregoing, the development of vehicle surge can be effectively restrained thus fulfilling the long desired demand, and the vehicle surge can be suppressed without impairing acceleration or deceleration characteristics of the engine or any other ordinary operation characteristics.

As many widely different embodiments of the present invention may be constructed without departing from the spirit and scope of the present invention, it should be understood that the present invention is not limited to the specific embodiments described in this specification, except as defined in the appended claims.

We claim:

1. An electronic fuel injection control apparatus of an internal combustion engine having a crankshaft, said apparatus comprising:

means for generating a first electrical signal at every crankshaft rotation of a predetermined angle;

means for generating a second electrical signal having a level which corresponds to a varying quantity in the period of said first electrical signal;

means, in response to said first electrical signal, for generating a third electrical signal having a variable period, a varying quantity of said third electrical signal period being maintained at a constant value or constant values irrespective of the varying quantity of said first electrical signal period when said second electrical signal is smaller than or equal to a predetermined value, a varying quantity of said third electrical signal period being changed in response to the varying quantity of said first electrical signal period when said second electrical signal is greater than the predetermined value; and means for adjusting the amount of fuel injected into the engine, in response to the period of said third electrical signal.

2. An apparatus as claimed in claim 1, wherein said second electrical signal generating means includes a period variation detecting means for generating an electrical signal having a level which indicates the difference between the present period of the first electrical signal and the previous period of the third electrical signal.

3. An apparatus as claimed in claim 2, wherein said period variation detecting means includes:

an up/down counting means for carrying out the up counting operation during a time corresponding to the previous period of the third electrical signal and for carrying out the down counting operation during a time corresponding to the present period of the first electrical signal; and a digital-analog converting means for converting the contents of said up/down counting means into an analog voltage signal having a level which indicates the difference between the present period of the first electrical signal and the previous period of the third electrical signal.

4. An apparatus as claimed in claim 1, wherein said third electrical signal generating means includes:

a signal generator, in response to said first electrical signal, for generating a triangular wave signal having a period equal to the first electrical signal period;

a reference signal generating means for generating a reference signal having a level which is changed in accordance with said second electrical signal when the second electrical signal is smaller than or equal to a predetermined value, and which level is maintained at predetermined constant levels when the second electrical signal is greater than the predetermined value; and a comparing means for comparing said triangular wave signal with said reference signal to generate said third electrical signal.

5. An apparatus as claimed in claim 4, wherein said reference signal generating means includes:

a first circuit for generating a fourth electrical signal having a level which is proportional to the second electrical signal level;

a second circuit for generating a constant signal having a constant level;

a third circuit for generating a fifth electrical signal having a level which consists of the sum of the levels of said fourth electrical signal and said constant signal; and a fourth circuit for limiting the level of said fifth electrical signal from said third circuit within a predetermined range, to generate said reference signal.

6. An apparatus as claimed in claim 4 or 5, wherein said comparing means includes:

a comparator for comparing the levels of said triangular wave signal and said reference signal, to generate a high level signal when said triangular wave signal level is greater than said reference signal level; and a monostable generator for generating said third electrical signal at every rising edge of said high level signal from said comparator.

* * * * *